US008651606B2

(12) United States Patent
Kakinuma et al.

(10) Patent No.: US 8,651,606 B2
(45) Date of Patent: Feb. 18, 2014

(54) PRINTING APPARATUS AND PRINTING METHOD

(75) Inventors: Akihiro Kakinuma, Hadano (JP); Akihiro Tomida, Kawasaki (JP); Naoki Uchida, Kawasaki (JP); Keita Tamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 13/011,205

(22) Filed: Jan. 21, 2011

(65) Prior Publication Data

US 2011/0187774 A1 Aug. 4, 2011

(30) Foreign Application Priority Data

Jan. 29, 2010 (JP) ..... 2010-019162

(51) Int. Cl.

| | |
|---|---|
| ***B41J 29/38*** | (2006.01) |
| ***B41J 29/393*** | (2006.01) |
| ***B41J 2/15*** | (2006.01) |
| ***B41J 2/145*** | (2006.01) |

(52) U.S. Cl.
USPC ..... 347/12; 347/19; 347/41

(58) Field of Classification Search
USPC ..... 347/12
See application file for complete search history.

(56) References Cited

U.S. PATENT DOCUMENTS

| | | | | |
|---|---|---|---|---|
| 6,789,867 | B2 | 9/2004 | Takahashi et al. | |
| 7,296,872 | B2 | 11/2007 | Hayashi et al. | |
| 2002/0154182 | A1 | 10/2002 | Takahashi et al. | |
| 2007/0013726 | A1 | 1/2007 | Hayashi et al. | |
| 2007/0279465 | A1 * | 12/2007 | Shindo | 347/89 |
| 2007/0291059 | A1 * | 12/2007 | Hayashi et al. | 347/12 |

FOREIGN PATENT DOCUMENTS

| | | | |
|---|---|---|---|
| JP | 2001-162912 | A | 6/2001 |
| JP | 2002-307672 | A | 10/2002 |
| JP | 2007-15261 | A | 1/2007 |

* cited by examiner

*Primary Examiner* — Uyen Chau N Le
*Assistant Examiner* — Kajli Prince
(74) *Attorney, Agent, or Firm* — Fitzpatrick, Cella, Harper & Scinto

(57) ABSTRACT

An inkjet printing apparatus and an inkjet printing method are provided which can correct, with high precision, print position deviations among a plurality of printing element arrays in each of a plurality of print modes that use different groups of printing elements in each printing element array. The adjustment values for the print position deviations between the first and second printing element arrays are differentiated between the high-speed mode and the high-quality mode. In the high-speed mode, all printing elements in the first and second printing element arrays are used. In the high-quality mode, a part of the printing elements in each of the first and second printing element arrays are used. Based on these adjustment values, the ink ejection timings of the first and second printing element arrays are adjusted.

22 Claims, 14 Drawing Sheets

PRINTING APPARATUS AND PRINTING METHOD

BACKGROUND OF THE INVENTION

1. Field of the Invention

The present invention relates to a printing apparatus and a printing method that print an image on a print medium by using a plurality of arrays of nozzles, each capable of ejecting ink onto the print medium.

2. Description of the Related Art

Generally a print head used in an inkjet printing apparatus has arrayed therein a plurality of nozzles (printing elements), each comprising an ink ejection opening and a liquid path to supply ink to the opening. To allow for printing color images, a plurality of such print heads corresponding to different color inks are used.

A serial scan type inkjet printing apparatus prints an image on a print medium by alternating a printing scan, that ejects ink from the ejection openings as the print head travels in a main scan direction, and a conveying operation that conveys the print medium in a sub-scan direction crossing the main scan direction. The print head is formed with a nozzle array (printing element array) having a plurality of nozzles arrayed in the sub-scan direction. For faster printing speed, a bidirectional printing method is employed, in which the printing scan is executed both when the print head is moved in one of two opposite directions (forward scan) along the main scan direction and when it is moved in the other direction (backward scan).

In an inkjet printing apparatus that prints an image by using a plurality of nozzle arrays formed in one or more print heads, image degradations may occur when print positions deviate among nozzle arrays. For example, in printing a pattern of vertical blue lines extending in the sub-scan direction, lines printed by a cyan ink nozzle array and lines printed by a magenta ink nozzle array must be aligned to overlap each other. If the print positions of these lines are shifted in the main scan direction, the lines fail to align with each other, making it impossible to print a pattern of high-quality vertical blue lines.

If image impairments are caused by such print position deviations, an adjustment needs to be made to align the print positions in the main scan direction among a plurality of nozzle arrays (also referred to as a "misregistration adjustment").

As one method for such a misregistration adjustment, Japanese Patent Laid-Open No. 2007-015261 discloses a method that determines inclinations of the nozzle arrays (inclinations of print heads) and misregistration adjustment values among a plurality of nozzle arrays.

However, when a plurality of printing modes are used, the print positions may not be able to be adjusted properly among a plurality of nozzle arrays depending on the printing mode. For example, in a printing mode that uses all nozzles of a nozzle array to print an image and in a printing mode that uses a part of the nozzles of the nozzle array, the effect that the inclination of the nozzle array has on the print position deviation differs. Even if the print position adjustment value among a plurality of nozzle arrays is determined after the nozzle array inclination adjustment value has been determined, as in Japanese Patent Laid-Open No. 2007-015261, there may remain a small difference in the inclination adjustment of a magnitude less than the adjustment resolution between the nozzle arrays. Even a slight difference in the nozzle array inclination may produce different effects on the print position deviations in different printing modes. This means that the use of a single misregistration adjustment value, which is determined considering the inclinations of nozzle arrays as described above, may not be able to properly adjust the print positions of nozzle arrays for different printing modes.

SUMMARY OF THE INVENTION

The present invention provides a printing apparatus and a printing method which, in each of a plurality of printing modes that use printing elements at different positions in a printing element array, can highly precisely correct print position deviations among a plurality of printing element arrays.

In the first aspect of the invention, there is provided a printing apparatus to print an image on a print medium by using a first printing element array and a second printing element array, each having a plurality of printing elements arrayed in a first direction to eject ink onto the print medium, and by moving the printing element arrays relative to the print medium in a second direction crossing the first direction, the printing apparatus comprising:

a print control unit configured to print an image in a first print mode or a second print mode, the first and second print modes using different range in printing elements in the first and second printing element arrays;

a first acquisition unit configured to acquire a first adjustment value for minimizing a first deviation in the second direction between a print position of those printing elements in the first printing element array that are used in the first print mode and a print position of those printing elements in the second printing element array that are used in the first print mode;

a second acquisition unit configured to acquire a second adjustment value for minimizing a second deviation in the second direction between a print position of those printing elements in the first printing element array that are used in the second print mode and a print position of those printing elements in the second printing element array that are used in the second print mode;

a first adjustment unit configured to, when printing an image in the first print mode, adjust the first deviation based on the first adjustment value acquired by the first acquisition unit; and a second adjustment unit configured to, when printing an image in the second print mode, adjust the second deviation based on the second adjustment value acquired by the second acquisition unit.

In the second aspect of the present invention, there is provided a printing method for printing a image on a print medium by using a first printing element array and a second printing element array, each having a plurality of printing elements arrayed in a first direction to eject ink onto the print medium, and by moving the printing element arrays relative to the print medium in a second direction crossing the first direction, the printing method comprising the steps of:

printing an image in a first print mode or a second print mode, the first and second print modes using different range in printing elements in the first and second printing element arrays;

acquiring a first adjustment value for minimizing a first deviation in the second direction between a print position of those printing elements in the first printing element array that are used in the first print mode and a print position of those printing elements in the second printing element array that are used in the first print mode; and acquiring a second adjustment value for minimizing a second deviation in the second direction between a print position of those printing elements in the first printing element array that are used in the second print mode and a print position of those printing elements in the second printing element array that are used in the second print mode, wherein, in the printing step, when an image is printed in the first print mode, the first deviation is adjusted based on the first adjustment value and, when an image is printed in the second print mode, the second deviation is adjusted based on the second adjustment value.

With this invention, in printing modes among which those printing elements in printing element arrays that are activated differ, print position deviations among printing element arrays can be corrected highly precisely, producing highly quality printed images. When different colors of ink are applied from different printing element arrays, satisfactory images with no color shift can be printed.

Further features of the present invention will become apparent from the following description of exemplary embodiments (with reference to the attached drawings).

DESCRIPTION OF THE EMBODIMENTS

Embodiments of this invention will be described by referring to the accompanying drawings.

First Embodiment

Figure 1:
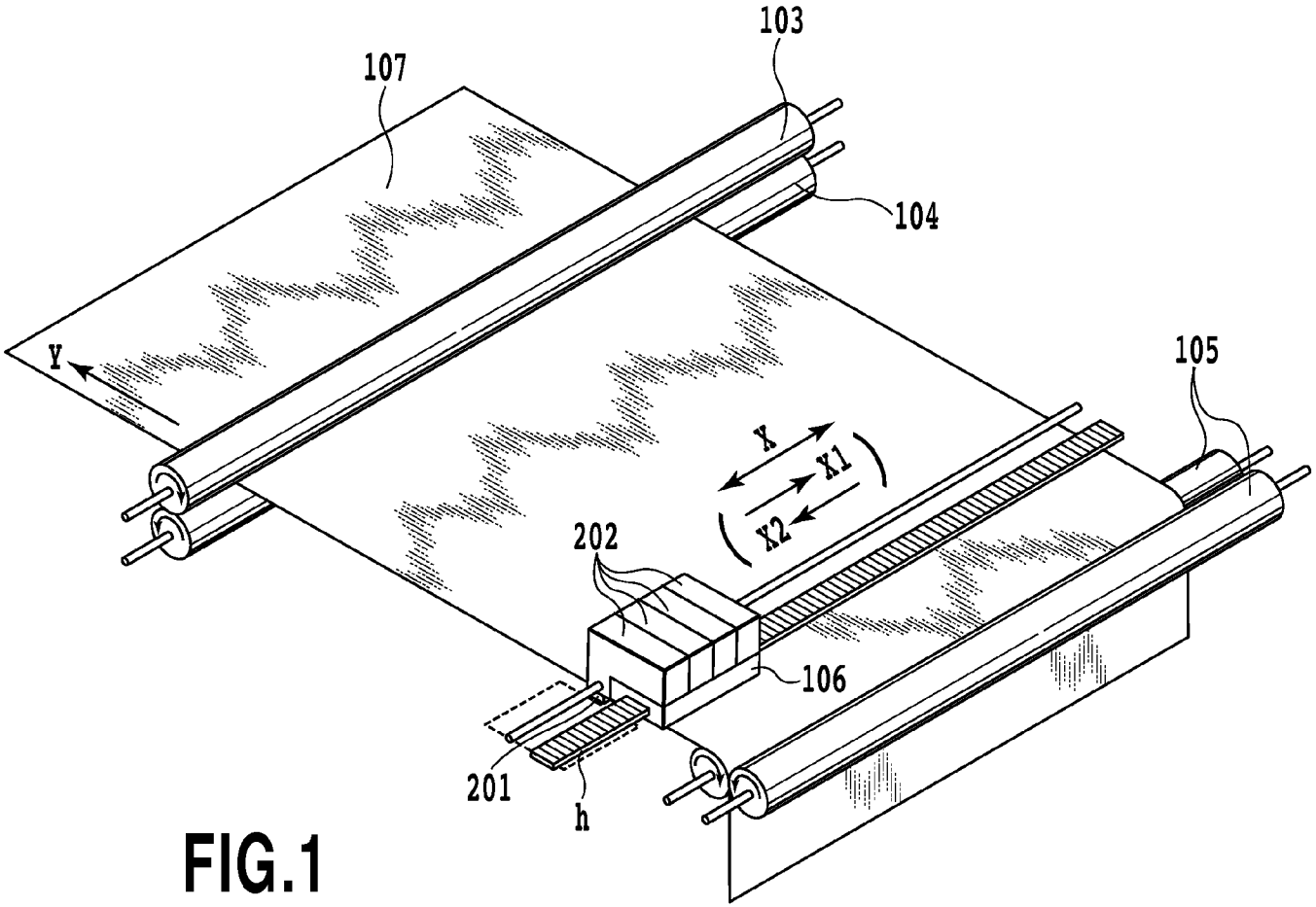
FIG. 1 is a perspective view showing essential portions of an inkjet printing apparatus to which this invention is applicable.

FIG. 1 is an outline perspective view showing one example construction of a color inkjet printing apparatus to which the present invention is applicable.

In FIG. 1, designated 202 is an ink cartridge including an ink tank and a print head 201. In this example four ink cartridges 202 for four color inks (black, cyan, magenta and yellow) are used. The ink cartridge 202 comprises an ink tank containing one of black, cyan, magenta and yellow inks and a print head 201 to eject the ink. The ink tank and the print head 201 may be constructed as separate components and take any desired construction other than the ink cartridge 202.

A pair of paper feed rollers 105 rotate in the directions of arrows while gripping paper (print medium) 107 in between to supply a sheet of paper. A paper conveying roller 103 in cooperation with an auxiliary roller 104 grips the paper 107 and conveys it in a sub-scan direction (first direction) of arrow Y as they rotate in the directions of arrows. A carriage 106 is movable in a main scan direction (second direction) of arrow X crossing the sub-scan direction (in this example, at right angles) and has four ink cartridges 202 detachably mounted thereon. The carriage 106, during the printing operation, travels together with the ink cartridges 202 in the main scan direction and, during non-printing operation or during a print head recovery operation, stands by at a home position h shown dashed in the figure. Arrow X1 represents a forward scan direction (also referred to as a "forward direction") and arrow X2 represents a backward scan direction (also referred to as a "backward direction").

The carriage 106 held at the home position h before the start of the printing operation, when it receives a print start command, begins to move in the forward direction of arrow X1. The print head 201 of the ink cartridge 202 ejects ink as it moves in the forward direction along with the carriage 106, printing (or forward scan) an area on the paper 107 equal in width to a printing width of the head 201. After the forward scan is completed, the carriage 106 moves in the backward direction of arrow X2 to return to its home position h. Then, it again moves in the forward direction of arrow X1 to execute the printing (forward scan). After the previous printing scan before the next printing scan is started, the paper conveying roller 103 rotates in the direction of arrow to convey the paper 107 a predetermined distance in the sub-scan direction. By alternately executing the printing scan and the conveying of the paper 107 as described above, an image is successively printed on the paper 107. The ink ejection from the print head 201 is controlled by a print control unit not shown.

For a faster printing speed, a bidirectional printing method may be employed to execute the printing not just when the carriage 106 moves in the forward direction but also in the backward direction (backward scan).

At a position where the print head undergoes a recovery operation, there are installed a cap adapted to cap the front face (nozzle opening surface) of the print head and a recovery unit that introduces a negative pressure into the interior of the cap when it caps the print head to remove viscous ink and bubbles from within the print head. There is also a cleaning blade by the side of the cap that wipes waste ink droplets and dirt off the front face of the print head.

Figure 2:
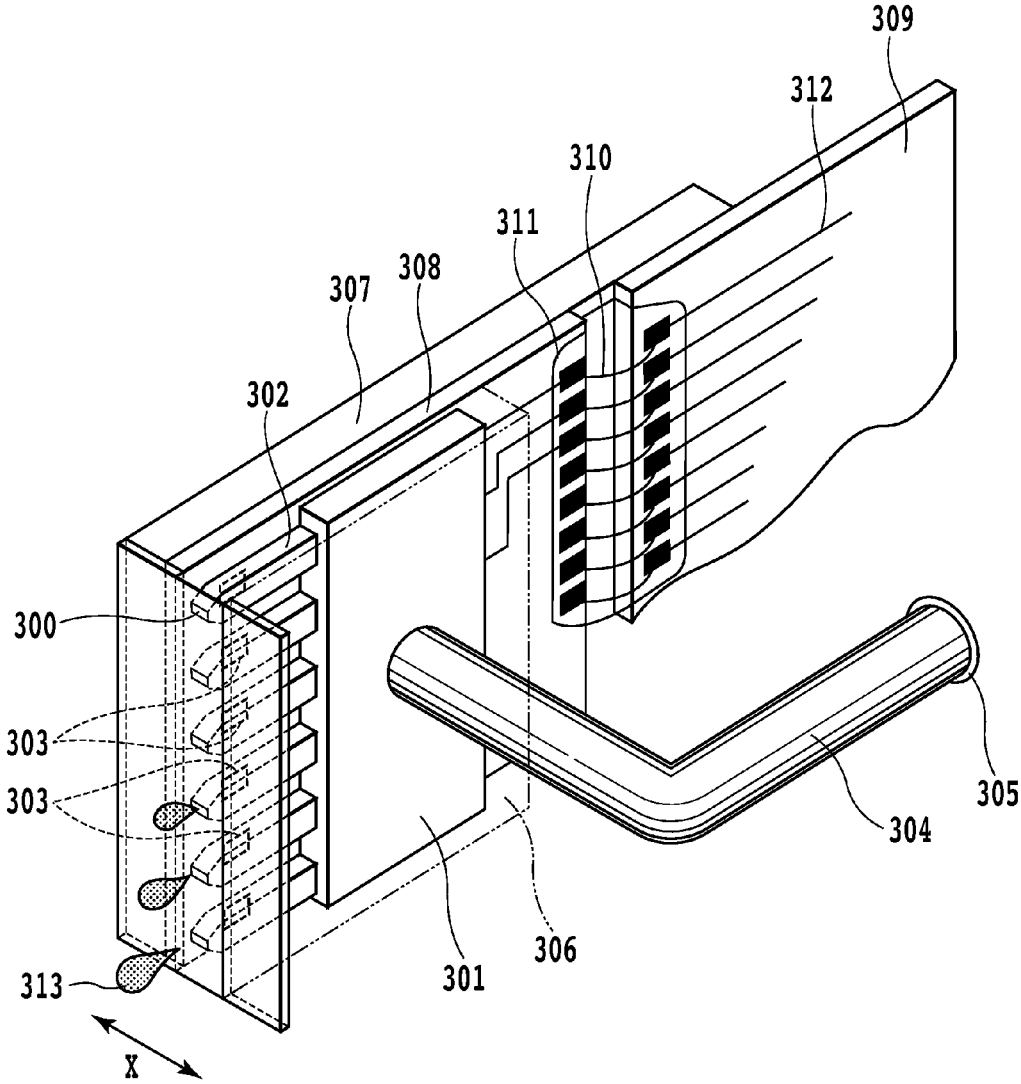
FIG. 2 is an enlarged perspective view of essential portions of a print head of FIG. 1, showing an example construction of the print head.

FIG. 2 is a perspective view of an example construction of the print head 201 with only its essential portions shown.

The print head 201 is formed with an array of ejection openings 300 arranged at a predetermined pitch, the array extending in a direction cross the main scan direction (in this example, in the sub-scan direction). In each of liquid paths 302 connecting the ejection openings 300 and a common liquid chamber 301, there is provided an ejection energy generating element 303 along a wall surface of the liquid path 302 for producing an energy to eject ink. In this example, electrothermal conversion element (heater) is used as the ejection energy generating element 303. It is also possible to use piezoelectric element instead. The ejection openings 300, the common liquid chamber 301, the liquid paths 302 and the ejection energy generating elements 303 combine to form ink ejection nozzles (printing elements).

The ejection energy generating elements (referred to simply as "heaters") 303 and their associated circuits may be formed on a silicon plate 308 by using the semiconductor fabrication technology. A temperature sensor and a sub-heater not shown can also be integrally formed on the same silicon plate 308 by a process similar to the semiconductor fabrication process. The silicon plate 308 formed with these electric wirings is bonded to a heat-dissipating aluminum base plate 307. A circuit connecting portion 311 on the silicon plate 308 is connected to a printed circuit board 309 through ultrafine wires 310. A signal from the printing apparatus body is received through a signal circuit 312. The liquid paths 302 and the common liquid chamber 301 are formed by an injection-molded plastic cover 306.

The common liquid chamber 301 is connected through a joint pipe 304 and an ink filter 305 to the ink tank, so that it is supplied with ink from the ink tank. The ink, supplied from the ink tank to the common liquid chamber 301 where it is temporarily stored, advances into the liquid paths 302 by capillary attraction and then in the ejection openings 300 forms meniscuses that keep it in the liquid paths 302. When the heater 303 is energized through an electrode not shown, it rapidly heat the ink to form a bubble in ink over the heater, causing the ink in the liquid path 302 to be ejected in the form of ink droplet 313 from the ejection opening 300 as the bubble expands.

Figure 3:
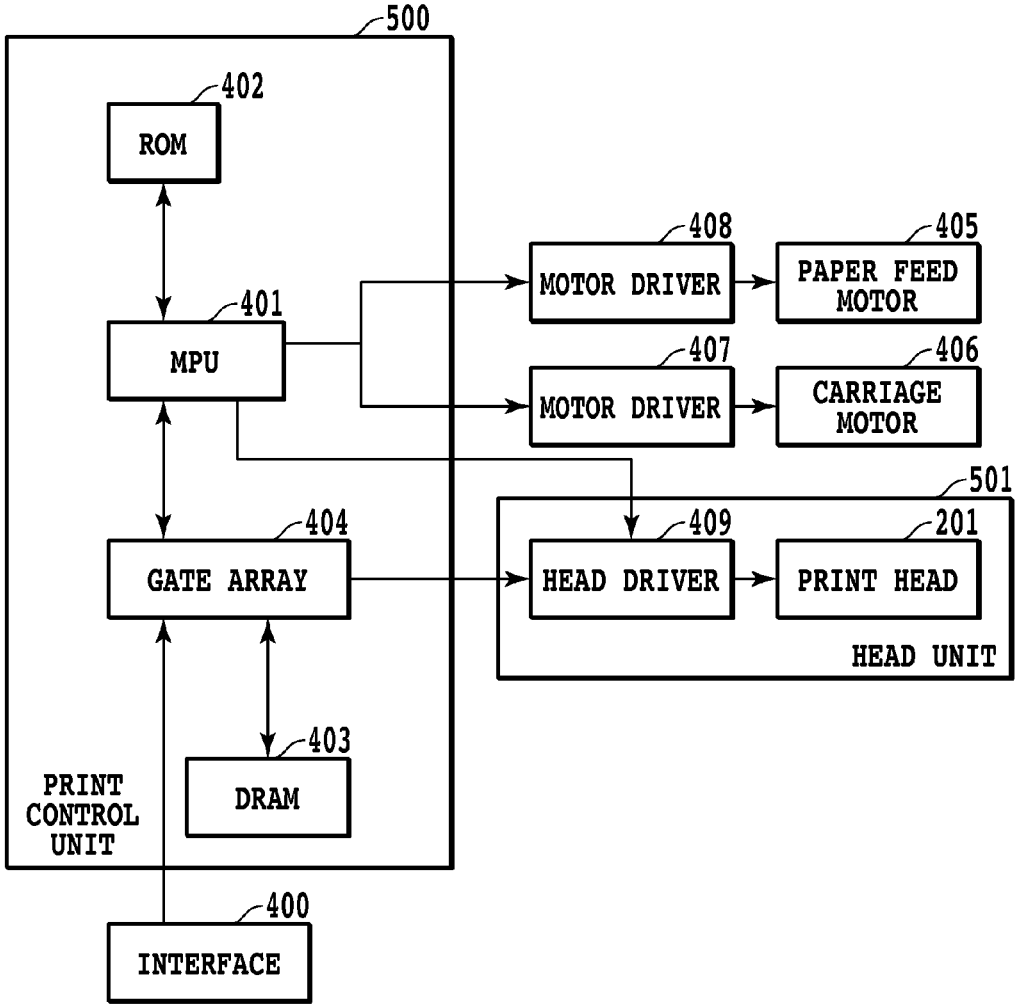
FIG. 3 is a block diagram of a control system in the printing apparatus of FIG. 1.

FIG. 3 is a block diagram showing a configuration of the control system in the printing apparatus.

Designated 400 is an interface to supply a print signal to the print control unit 500, 401 an MPU, and 402 a ROM for storing a control program to be executed by the MPU 401. Denoted 403 is a dynamic RAM (DRAM) to store various kinds of data (e.g., print signal and print data to be supplied to the print head). It can also store the number of dots to be formed and the number of times that the print head has been renewed. Reference number 404 represents a gate array 404 to control the supply of print data to the print head and also the data transfer among the interface 400, the MPU 401 and the DRAM 403. Denoted 406 is a carrier motor (CR motor) to move the carriage 106 in the main scan direction and 405 a conveying motor (LF motor) to convey the paper 107 in the sub-scan direction. Reference numbers 407 and 408 represent motor drivers to drive the conveying motor 405 and the carrier motor 406. In a head unit 501, a head driver 409 drives the print head 201.

In this example, four nozzle arrays (printing element arrays) arranged in the main scan direction eject four primary color inks—black, cyan, magenta and yellow—to print an image on the paper 107. The nozzle arrays each have 1,200 ejection openings 300 arrayed in the sub-scan direction at 1,200-dpi intervals and measures 1 inch long.

Figure 4A:
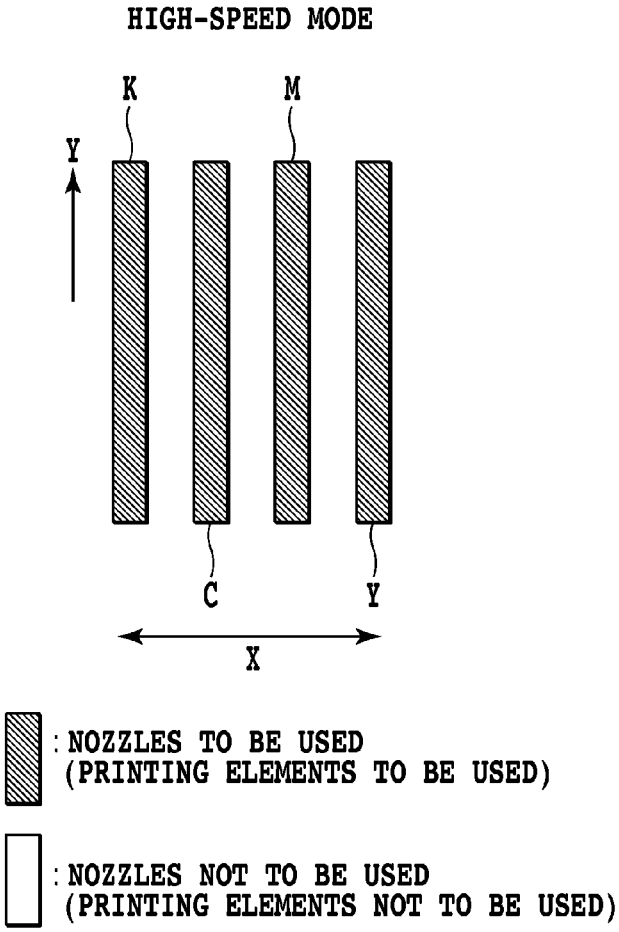
FIG. 4A is a schematic view of nozzles used in a high-speed mode.
Figure 4B:
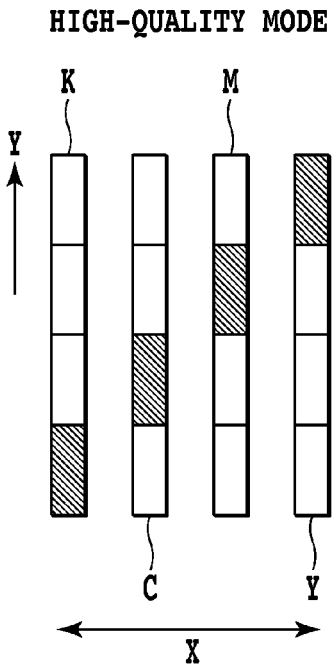
FIG. 4B is an explanatory view of nozzles used in a high-quality mode.

The printing apparatus has two print modes to be selected by the user according to the purpose and use of printing—"high-speed mode (first print mode)" and "high-quality mode (second print mode)". In FIG. 4A and FIG. 4B, K, C, M and Y represent nozzle arrays to eject black, cyan, magenta and yellow ink respectively. The "high-speed mode", as shown in FIG. 4A, uses all the nozzles in every nozzle array while the "high-quality mode" uses different groups of nozzles in different nozzle arrays, as shown in FIG. 4B. So, in the "high-speed mode" the positions of nozzles used in each of the nozzle arrays match in the sub-scan direction and, in the "high-quality mode", they shift in the sub-scan direction. In the "high-quality mode" since the ranges of nozzles used in each of the nozzle arrays differ in the sub-scan direction, the order of ink ejection of different color inks can be kept constant even during the bidirectional printing, helping to realize a high-quality image printing.

Now, examples of "high-speed mode" and "high-quality mode" will be explained in connection with printed position deviations, as follows.

Example of High-Speed Mode

Figure 5A:
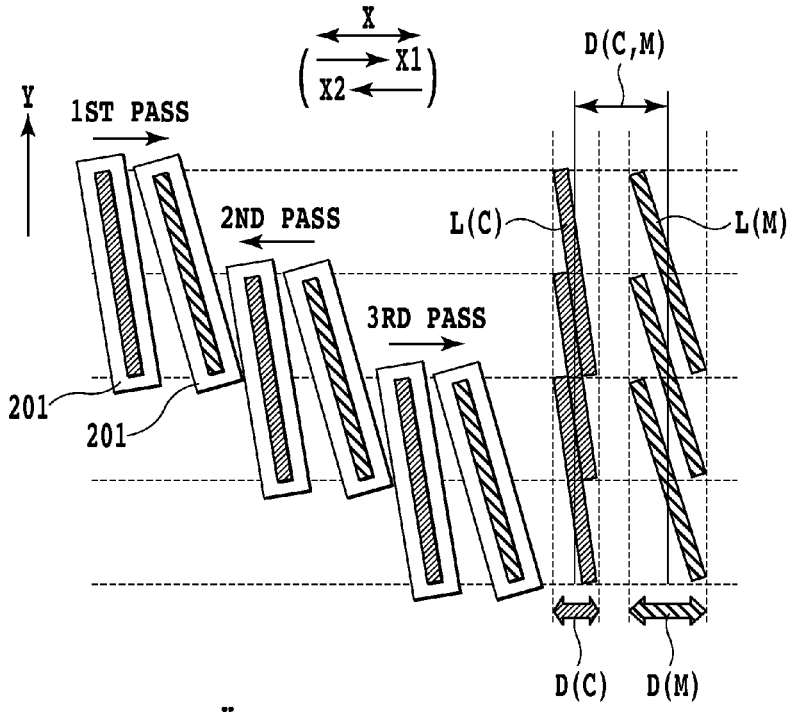
FIG. 5A is a schematic view explaining a print position deviation among nozzle arrays in the high-speed mode.
Figure 5B:
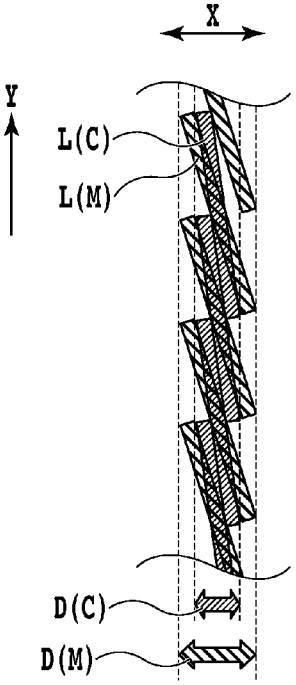
FIG. 5B is a schematic view showing a printed image after the misregistration adjustment has been made.

FIG. 5A and FIG. 5B illustrate an example of how vertical lines are printed in the high-speed mode. In this example, of the four nozzle arrays for four color inks, a cyan ink nozzle array (first printing element array) C and a magenta ink nozzle array (second printing element array) M are used to form blue vertical lines in a bidirectional 2-pass printing by using all nozzles of these arrays. It is assumed that the nozzle arrays C and M have different inclinations with respect to the sub-scan direction, as shown in FIG. 5A. L(C) in the figure represents lines of cyan ink printed on the paper and L(M) represents printed lines of magenta ink.

When a position deviation D(C, M) in FIG. 5A occurs between lines L(C) and L(M), the printed vertical blue line is recognized as having a color deviation. D(C) represents a position deviation in the main scan direction of line L(C) caused by the inclination of the nozzle array C and D(M) represents a position deviation in the main scan direction of line L(M) caused by the inclination of the nozzle array M.

FIG. 5B shows a printed result after an adjustment has been made of the print positions of lines L(C) and L(M) printed by the nozzle arrays C and M to eliminate the print position deviation D(C, M) (this adjustment is also called a "misregistration adjustment"). In this example, the misregistration adjustment was made by controlling the ink ejection timing so that the print positions of nozzles situated near the centers of the nozzle arrays C, M are aligned in the main scan direction. Although there is a difference in print width between line L(C) and line L(M), which have the position deviations D(C) and D(M) caused by the inclinations of the nozzle arrays C, M respectively, the printed image is good enough so that color deviations are hardly recognizable.

Example of High-Quality Mode

Figure 6A:
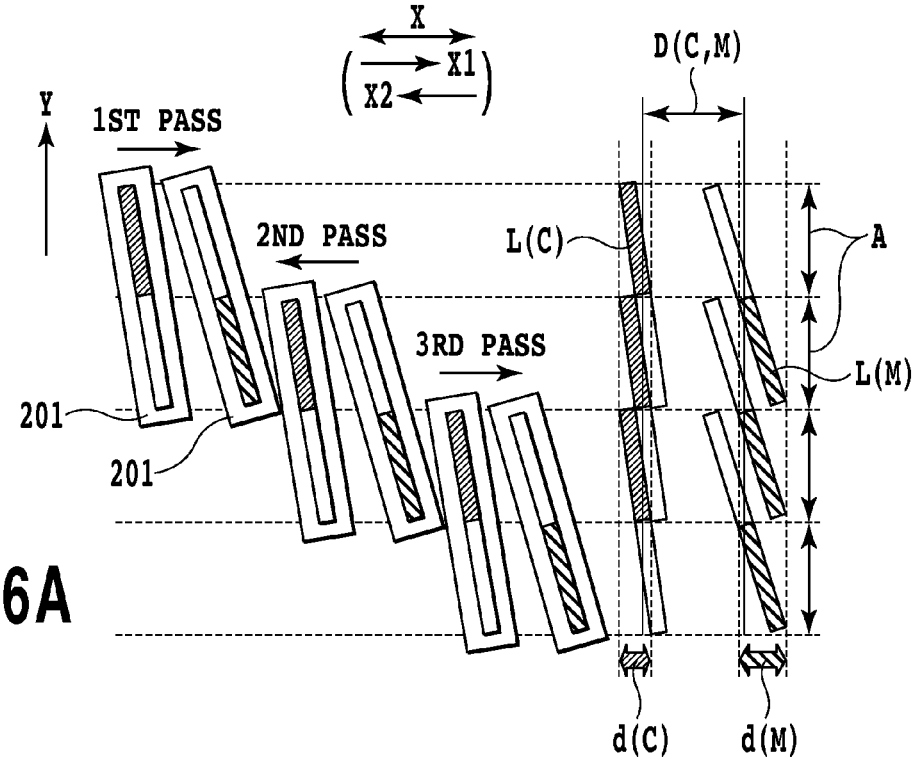
FIG. 6A is a schematic view explaining a print position deviation among nozzle arrays in the high-quality mode.
Figure 6B:
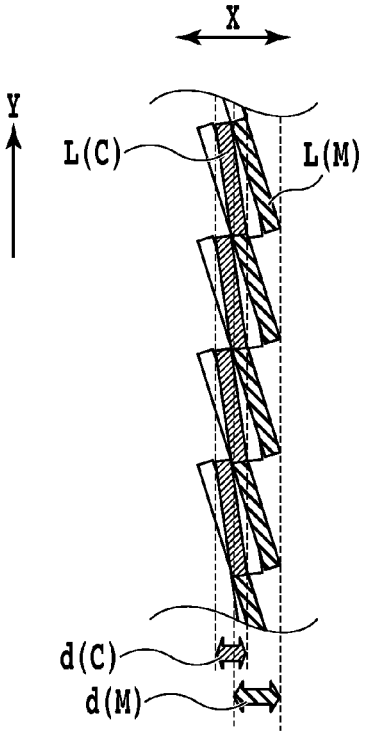
FIG. 6B is a schematic view of a printed image after the misregistration adjustment has been made.
Figure 6C:
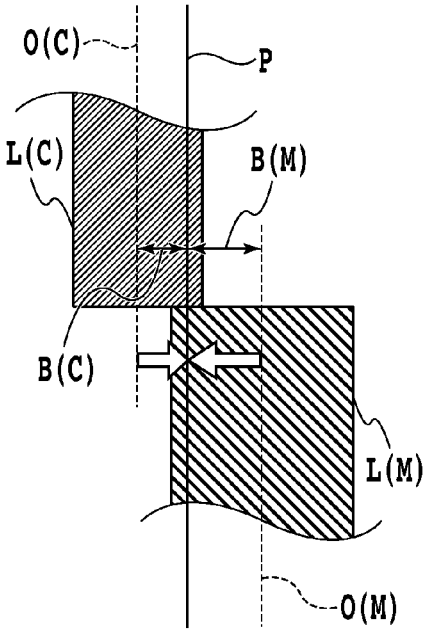
FIG. 6C is an enlarged view of essential portions of the printed image of FIG. 6B.

FIGS. 6A, 6B and 6C illustrate an example of how vertical lines are printed in the high-quality mode. In this example, of the four nozzle arrays for four color inks, a cyan ink nozzle array C and a magenta ink nozzle array M are used to form blue vertical lines on the paper in a 2-pass bidirectional printing by using an upper half of nozzles in the cyan ink nozzle array C and a lower half of nozzles in the magenta ink nozzle array M. It is assumed that the nozzle arrays C, M have the same inclinations as in the case of FIG. 5A. L(C) represents a line of cyan ink formed on the paper and L(M) represents a line of magenta ink.

In unit print areas (bands) A on the paper printed by two scans of the print head, the order of ejection of cyan and magenta inks (or the order of ink application) remains the same. In this example, the magenta ink line L(M) is first printed in the forward scan, followed by the cyan ink line L(C) being formed in the backward scan. As described above, keeping the magenta-cyan ink ejection order unchanged for all unit print areas in the high-quality mode allows for printing images of even higher quality. If the ink ejection order differs between the forward scan and the backward scans, density difference and color difference may occur in the printed images.

If print position deviation D(C, M) of FIG. 6A occurs with lines L(C), L(M), as in the case of FIG. 5A, the printed vertical blue line is recognized as having color deviation. Denoted d(C) is a position deviation in the main scan direction of line L(C) caused by the inclination of the nozzle array C and d(M) represents a position deviation in the main scan direction of line L(M) caused by the inclination of the nozzle array M. These deviations d(C) and d(M) are smaller than the aforementioned deviations D(C) and D(M) of FIG. 5A and FIG. 5B.

FIG. 6B shows a printed result after a misregistration adjustment, similar to the one shown in FIG. 5B, has been made of the print positions of lines L(C), L(M) printed by the nozzle arrays C, M to eliminate the print position deviation D(C, M). In more detail, the misregistration adjustment was made by controlling the ink ejection timing in a way that aligns, in the main scan direction, the print position of a nozzle situated near the center of the nozzle array C with that of a nozzle situated near the center of the nozzle array M. Such a misregistration adjustment, however, has a problem that a center line O(C) of the printed line L(C) and a center line O(M) of the printed line L(M) may deviate from each other in the main scan direction, as shown in FIG. 6C, causing color deviation in the printed blue vertical line. Referring to FIG. 6C, reference symbol P denotes a position in the main scan direction of pixels printed by nozzles situated near the centers of the nozzle arrays C, M (misregistration adjustment position). B(C) represents a deviation between the position P and the center line O(C) of the printed line L(C), and B(M) represents a deviation between the position P and the center line O(M) of the printed line L(M).

As described above, if a misregistration adjustment similar to the one performed in the high-speed mode is made in the high-quality mode, a color deviation may occur rendering the high-quality printing impossible. The possible causes of color deviation include inclinations of nozzle arrays as well as the limited use of nozzles in the high-quality mode.

Another Example of High-Quality Mode

Figure 7A:
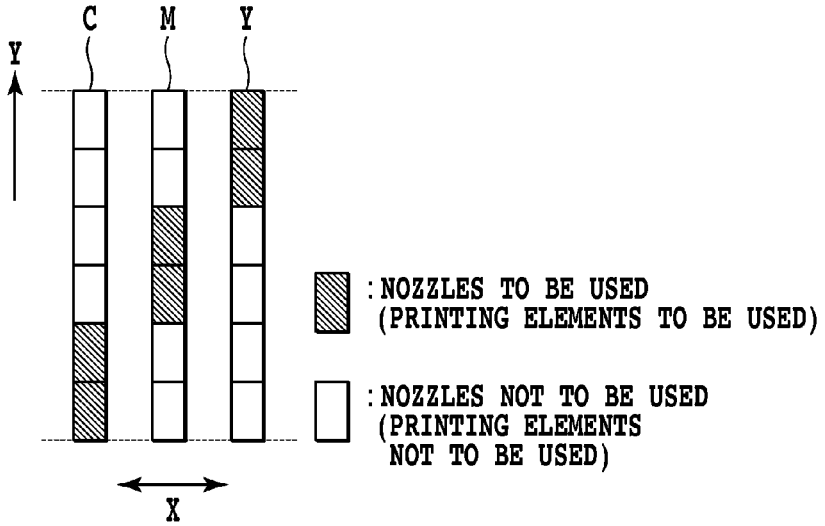
FIG. 7A is a schematic diagram showing nozzles used in the high-quality mode during a 6-pass printing operation.
Figure 7B:
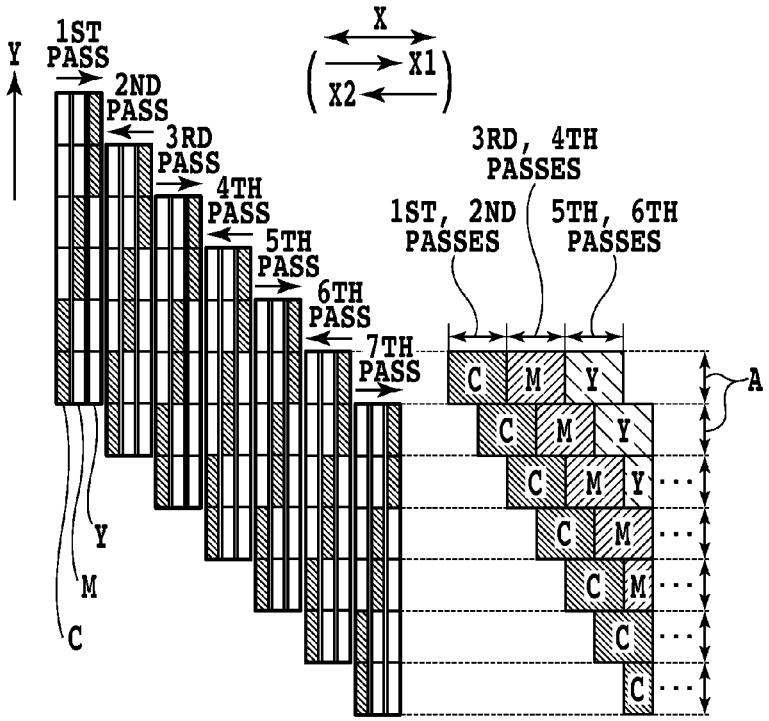
FIG. 7B is a schematic diagram showing the order in which different inks are ejected in the high-quality mode during the 6-pass printing operation.

FIG. 7A and FIG. 7B show another example of high-quality mode. In this example, an image is formed by a bidirectional 6-pass printing using nozzle arrays C, M, Y. As shown in FIG. 7A, the nozzle array C is operated using one third of its nozzles on the upstream side in the print medium conveyance direction; the nozzle array M is operated using one third of its nozzles on the central side in the print medium conveyance direction; and the nozzle array Y is operated using one third of its nozzles on the downstream side in the print medium conveyance direction. In the forward and backward scans, cyan, magenta and yellow inks are ejected from these nozzles in a fixed ink ejection order that is kept constant throughout all unit print areas A, as shown in FIG. 7B. This reduces color differences among unit print areas (bands), producing an image of higher quality.

If in such a high-quality mode the misregistration adjustment similar to the one performed in the high-speed mode is executed as in the case of FIGS. 6A, 6B and 6C, there is a possibility of a high-quality image not being able to be printed.

In this embodiment, to produce images with no color deviations in any of the print modes, different print position adjustment values are used in different print modes.

(Setting of Adjustment Value for Each Print Mode)

Figure 8:
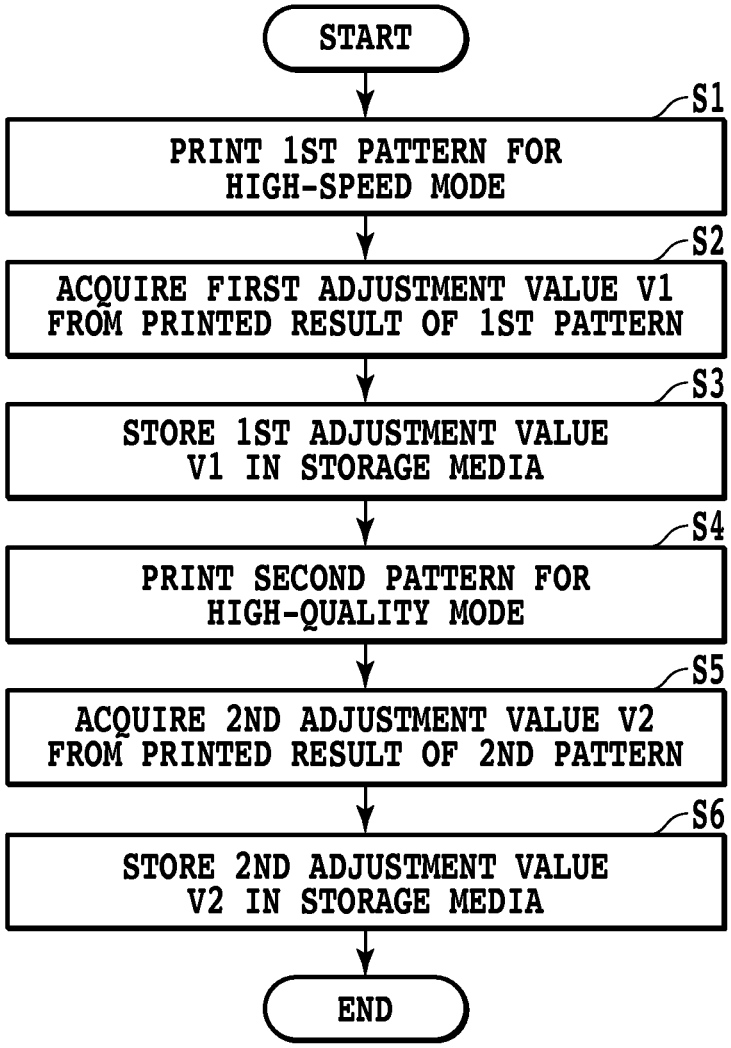
FIG. 8 is a flow chart showing an operation to acquire adjustment values for the print position deviations in the high-speed mode and the high-quality mode in a first embodiment of this invention.

FIG. 8 shows a flow chart for acquiring print position adjustment values for a high-speed mode and for a high-quality mode.

First, from step S1 to step S3, a print position adjustment value (misregistration adjustment value) for high-speed mode is acquired as a first adjustment value V1 and then stored in a storage media. More specifically, by using those nozzles that are used in high-speed mode, a predetermined pattern (first pattern) dedicated for high-speed mode is printed (step S1) and, from the printed result, the first adjustment value V1 is acquired (step S2). The first adjustment value V1 is then stored in a desired region (first storage portion) of the ROM 402 (see FIG. 3) (step S3).

Figure 9:
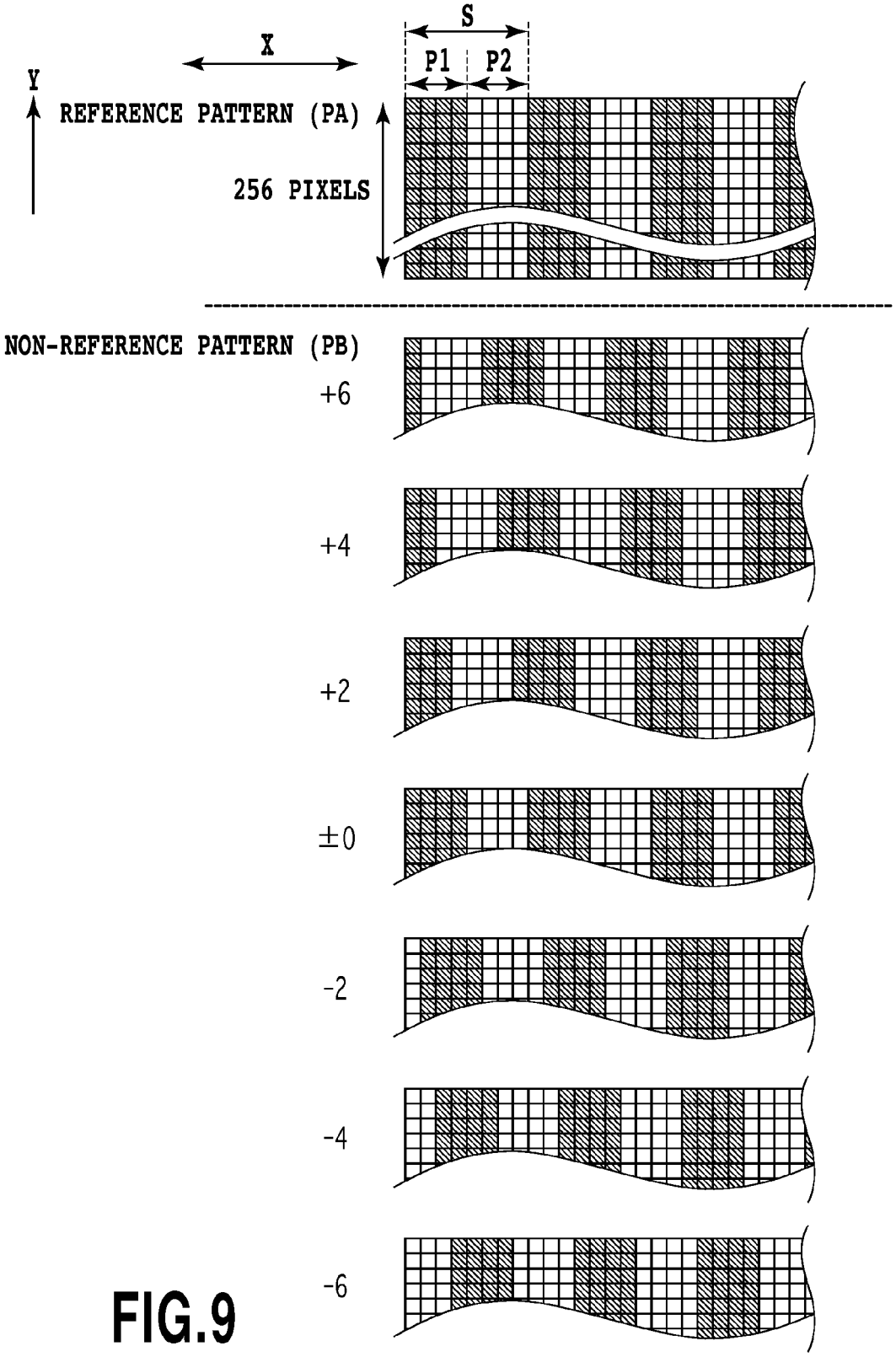
FIG. 9 illustrates patterns printed to acquire adjustment values for the print position deviations.

The first pattern is a combination of two overlapping patterns—a reference pattern PA of a black ink ejected from the nozzle array K and a non-reference pattern PB of one of other inks (see FIG. 9). The non-reference pattern PB includes a cyan ink pattern printed by the nozzle array C, a magenta ink pattern printed by the nozzle array M and a yellow ink pattern printed by the nozzle array Y. The first pattern includes a pattern formed by a non-reference pattern PB of cyan ink overlapping the reference pattern PA, a pattern formed by a non-reference pattern PB of magenta ink overlapping the reference pattern PA, and a pattern formed by a non-reference pattern PB of yellow ink overlapping the reference pattern PA. These non-reference patterns PB further include seven patterns with different offsets. So, the seven non-reference patterns PB are each overlapped with the reference pattern PA to form a group of first patterns.

In this example, the reference pattern PA has a vertical length (in the sub-scan direction) equivalent to 256 pixels and a horizontal width (in the main scan direction) measuring about 10 mm. A set S of eight pixels comprising a 4-pixel print segment p1 and a 4-pixel blank segment p2 is repetitively formed in the main scan direction. The seven non-reference patterns PB are formed in a way similar to that of the reference pattern PA. It is noted, however, that the seven non-reference patterns PB are laterally offset from the reference pattern PA by different amounts, with the sets S of one non-reference pattern PB being shifted one column laterally from the sets S of the preceding non-reference pattern PB.

In this example, the nozzle arrays each have 1,200 nozzles formed in the sub-scan direction at 1,200-dpi intervals. So they have a resolution of 1,200 dpi in the sub-scan direction. Their resolution in the main scan direction is also 1,200 dpi. In this example, the first adjustment value V1 is acquired in units of 2,400 dpi, double the resolution of 1,200 dpi. So, those non-reference patterns PB that have their sets S offset one column left and right from the reference pattern PA are shown in FIG. 9 to have an offset of +2 and an offset of −2, respectively. Similarly, the non-reference patterns PB with their sets S offset 2 columns left and right are designated as an offset of +4 and an offset of −4, respectively. The non-reference patterns PB with their sets S offset 3 columns left and right are designated as an offset of +6 and an offset of −6, respectively. The non-reference pattern PB whose sets S are not offset are designated as an offset of ±0.

As described above, for each of cyan, magenta and yellow ink, seven non-reference patterns PB with different offsets, each overlapping with the reference pattern PA, are printed as the first patterns (step S1). Next, from the printed result of these first patterns, a first adjustment value V1 for the high-speed mode is acquired (step S2). So, to print the first patterns, the head unit 501 functions as a first pattern printing unit under the control of the print control unit 500.

Figure 10A:
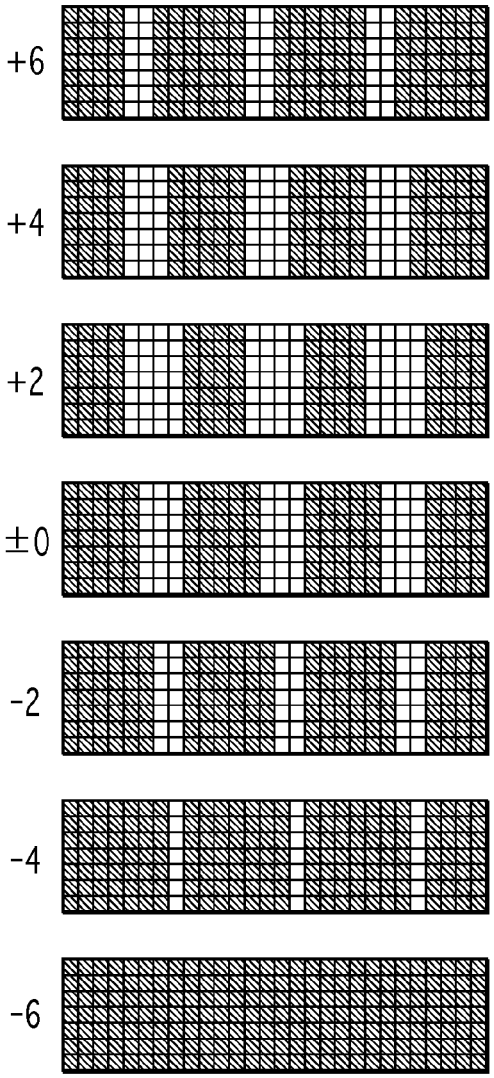
FIGS. 10A and 10B illustrate printed results of different patterns of FIG. 9.
Figure 10B:
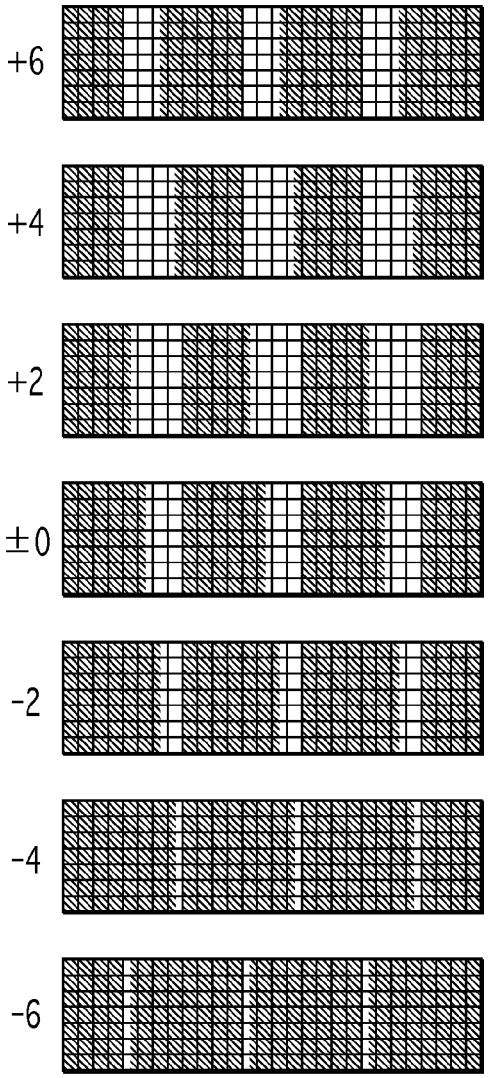

FIG. 10A and FIG. 10B show other examples of printed results of the first patterns.

The first patterns are printed as follows. First, the reference pattern PA of a reference color (black) is printed using 256 nozzles situated near the center of the nozzle array K. Next, a non-reference pattern PB with an offset of +6 is printed using 256 nozzles of the nozzle array C to overlap the reference pattern PA. The 256 nozzles of the nozzle array C are at the same positions in the sub-scan direction as those nozzles of the nozzle array K used in printing the reference pattern PA. Similarly, the remaining non-reference patterns PB with different offsets are printed to overlap the reference pattern PA until a total of seven first patterns are formed. As described later, from among the seven first patterns, a pattern with the lowest density is selected so that the print position deviation of the nozzle array C relative to the nozzle array K can be obtained quantitatively. For example, the user can determine the print density of the pattern and then enter an amount of deviation acquired based on the determined pattern density. It is also possible to measure the print densities of the patterns using a sensor and, based on the result of measurements, automatically acquire the amount of position deviation.

FIG. 10A shows an example of seven first patterns printed by the nozzle array K and nozzle array C.

In this example, a pattern formed by combining the reference pattern and a non-reference pattern with an offset of +2 is found to be lowest in density or grayscale level. Since the resolution of the first patterns in the main scan direction is 1,200 dpi, the offset "+2" is equivalent to a print position shift of about 42 μm. The print position adjustment between the nozzle array K and C can be made by taking the offset of "+2" as a print position adjustment value V1(C) and shifting the cyan ink ejection timing with respect to the black ink ejection timing by an amount equivalent to the offset of "+2" to eliminate the position deviation between the two nozzle arrays.

FIG. 10B shows another example of seven first patterns printed by the nozzle array K and nozzle array C. In this example, two patterns are found to have the lowest density—a pattern formed by a combination of the reference pattern and a non-reference pattern with an offset of +2 and a pattern formed by a combination of the reference pattern and a non-reference pattern with an offset of +4. In this case, the position deviation may be taken as "+3", a median value between "+2" and "+4". That is, the print position adjustment value V1(C) can be acquired in units of 2,400 dpi, double the resolution of 1,200 dpi.

Similarly, from the printed result of the first patterns, the print position adjustment values V1(M) and V1(Y) for the nozzle arrays M, Y with respect to the nozzle array K are acquired. Therefore, the first acquisition unit for acquiring the first adjustment value (V1) includes a first pattern printing unit, an input unit for entering the pattern printed result (position deviation) and an MPU 401 for calculating the adjustment value based on the position deviation. The first adjustment value may be acquired by sensing the surface of the print head where the nozzle arrays are formed, using an optical sensor to determine the positional relation among nozzle arrays. That is, the first acquisition unit does not have to include the first pattern printing unit.

In the subsequent steps S4 to S6, the print position adjustment value (misregistration adjustment value) for the high-quality mode is acquired as a second adjustment value V2 and stored in the storage media. The adjustment value V2 can be acquired in a way similar to that for the first adjustment value V1. It is noted, however, that the second patterns printed to acquire the adjustment value V2 are printed using those nozzles for the high-quality mode. That is, by using the nozzles for the high-quality mode, the similar patterns to the first patterns described above are printed as the second patterns. Therefore, the second patterns are intended to acquire the second adjustment value. To print the second patterns, the head unit functions as a second pattern printing unit under the control of the print control unit 500. The adjustment values V2(C), V2(M), V2(Y) for the position deviations of nozzle arrays C, M, Y with respect to the nozzle array K are stored in a predetermined region (second storage portion) of the ROM 402 (see FIG. 3). The second acquisition unit for the second adjustment values (V2) includes a second pattern printing unit, an input unit for entering the pattern printed result (position deviation) and an MPU 401 for calculating the adjustment value based on the position deviation. It is noted that the second acquisition unit does not have to include the second pattern printing unit.

As described above, this embodiment prints in each print mode predetermined patterns using those nozzles assigned for the selected mode and, based on the printed results, position deviation adjustment values are acquired. This allows an optimal adjustment value to be used in the print position deviation adjustment to prevent possible color deviations even in cases where, in such a print mode as a high-speed mode in which the number and positions of the nozzles used differ among different nozzle arrays, there are variations in inclination among different print heads.

The first and second patterns described above are just one example and the resolution may be raised further to enhance the precision of detection of the inclinations of nozzle arrays. It is also possible to increase the detection range of inclination by extending the horizontal size of the patterns or increasing the number (or kinds) of non-reference patterns. In cases where the number of nozzles used in each nozzle array is fewer than 256, there may arise a need to change patterns according to a variety of print conditions, as by reducing the vertical size of the first and second patterns. Furthermore, the processing shown in FIG. 8 to determine the print position adjustment values in the main scan direction may be executed after acquiring the inclination adjustment values for the nozzle arrays K, C, M, Y and correcting the inclinations of the nozzle arrays based on the inclination adjustment values. That is, even after the nozzle array inclination adjustment has been made, an inclination mismatch of a magnitude less than the inclination adjustment resolution may remain. So, the same effect as the one described above can be produced by determining the main scan direction registration adjustment value in each of the print modes with different ranges of the nozzles used.

Second Embodiment

Figure 11:
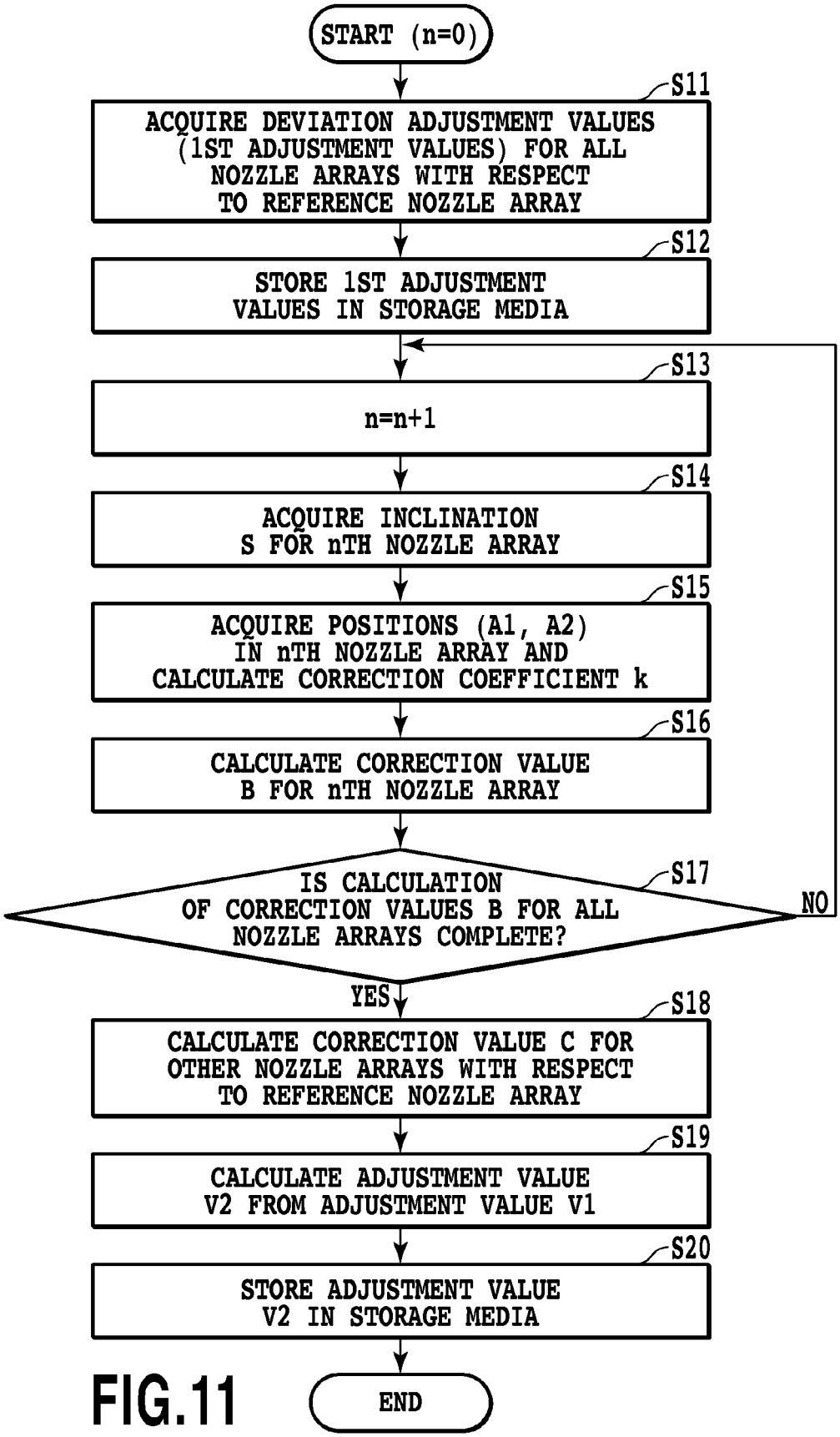
FIG. 11 is a flow chart showing an operation to acquire inclinations of nozzle arrays in a second embodiment of this invention.

FIG. 11 is a flow chart showing the method of acquiring the print position adjustment values for the high-speed mode and the high-quality mode, respectively.

First, at step S11, print position adjustment values (first adjustment values) V1 for all nozzle arrays with respect to one reference nozzle array are acquired. In this example, the nozzle array K is taken as the reference nozzle array, and the print position adjustment values V1(C), V1(M), V1(Y) for the nozzle arrays C, M, Y with respect to the reference nozzle array K are acquired.

The method of acquiring these adjustment values is similar to step S1 and S2 of FIG. 8. These adjustment values are stored in a predetermined area (first storage portion) in the ROM 402 (see FIG. 3) as by input from the user (step S12).

Next, the number n of nozzle arrays, which is initially set at "0", is counted up (step S13). The nozzle array number represents the total number of nozzle arrays, which is four in this example. Then, an inclination S of an n-th nozzle array with respect to the sub-scan direction is acquired (step S14).

The inclination S of the nozzle array in this example will be explained below.

Figure 12:
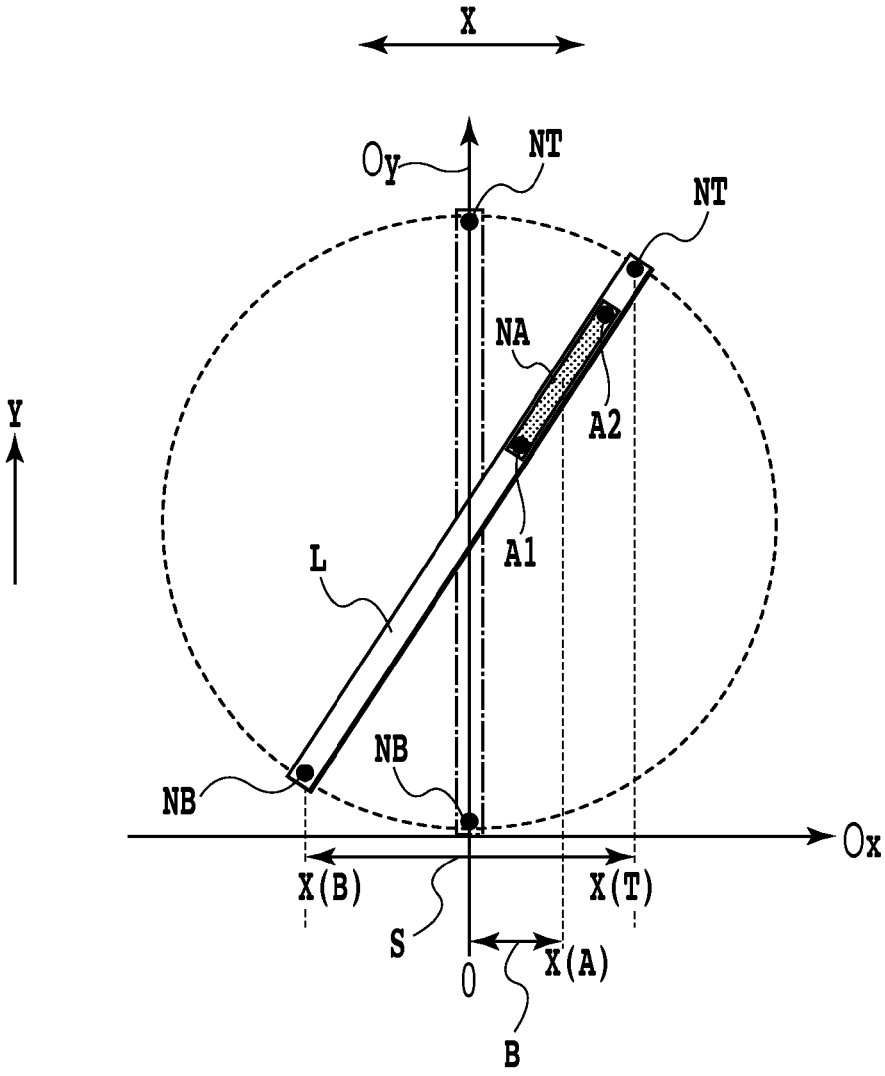
FIG. 12 is a schematic diagram showing a relation between the inclination and a correction value in the second embodiment of this invention.

FIG. 12 shows a nozzle array L being rotated about a middle point of its length in a plane defined by an axis extending in the main scan direction (main scan axis), Ox, and an axis extending in the sub-scan direction (sub-scan axis), Oy. In FIG. 12, an uppermost nozzle NT of the nozzle array L is projected onto the axis Ox and its projected point on the axis Ox is designated X(T). A point on the axis Ox at which a lowermost nozzle NB of the nozzle array L is projected to the axis Ox is designated X(B). The axis Ox has a zero point where it crosses the axis Oy at right angles. On the right side of the zero point in the FIG. 12 the axis Ox takes positive values while on the left side it takes negative values. In this example, a value X(T)-X(B) is defined as the inclination S of the nozzle array L. If the nozzle array L is not inclined, as shown by a one-dot chain line in FIG. 12, S=0. If the nozzle array L is inclined, S≠0. Depending on whether S takes a negative value (S<0) or a positive value (S>0), the direction of inclination of the nozzle array L (direction of rotation) can be determined.

Figure 13:
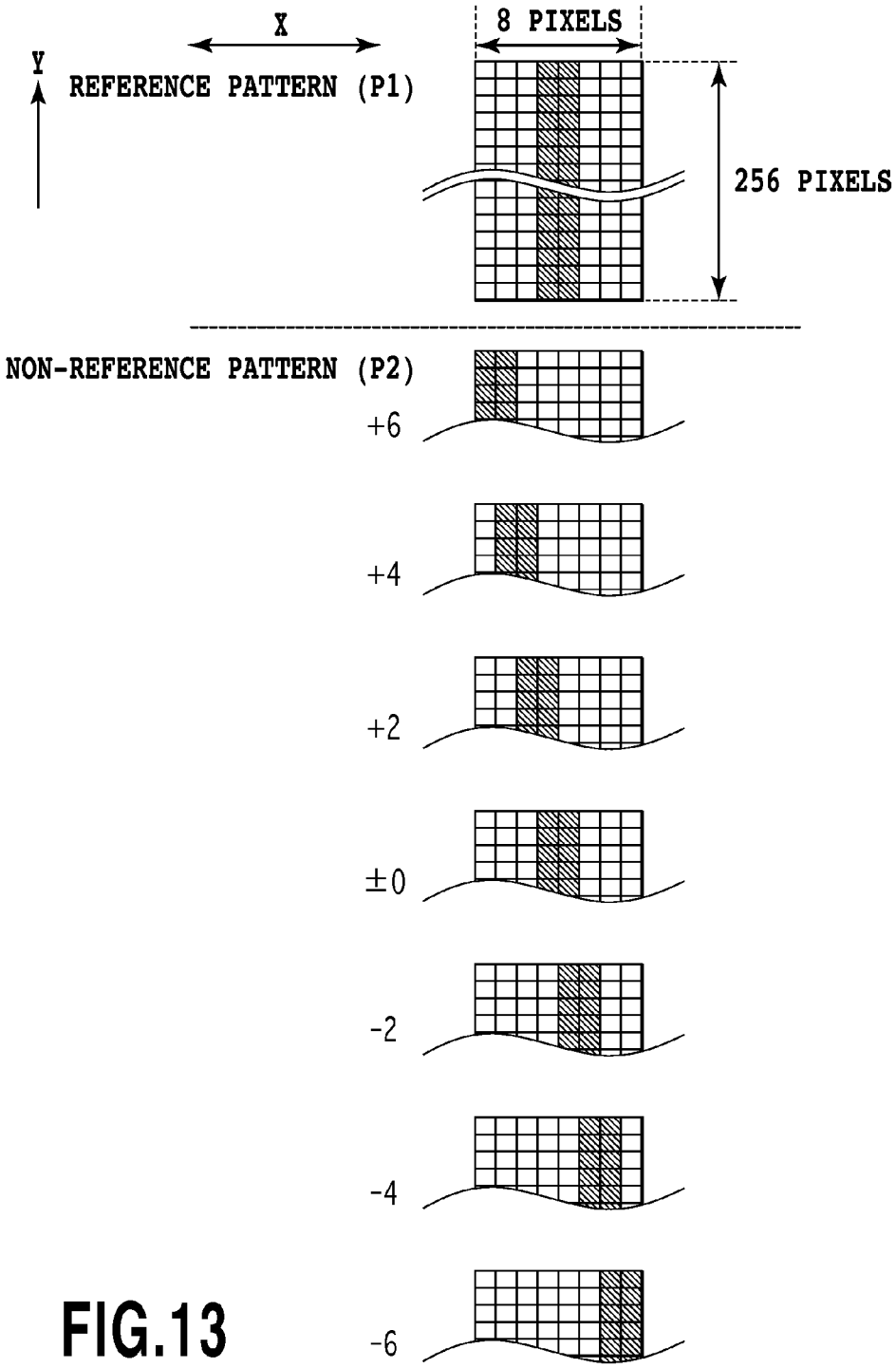
FIG. 13 illustrates patterns printed to acquire an inclination of a nozzle array.

FIG. 13 shows an example of patterns printed on a print medium to acquire the inclination S of the nozzle array L. The patterns are a combination of a reference pattern P1 and non-reference patterns P2.

Each of the patterns P1, P2 has a length equivalent to 256 pixels in a vertical direction (sub-scan direction), a width of 8 pixels in a horizontal direction (main scan direction) and a resolution of 1,200 dpi in both vertical and horizontal directions. The reference pattern P1 is used to print a 2-pixel-wide vertical line consisting of two vertically extending 256-pixel dot columns (fourth and fifth columns from the left end of the pattern made up of eight vertical columns arranged side by side in the horizontal direction). The non-reference pattern P2, similar to the reference pattern P1, is also used to print a 2-pixel wide vertical line consisting of two vertically extending 256-pixel dot columns. It is noted, however, that there are seven different non-reference patterns P2. The position of the printed vertical line shifts one pixel to the right from the left end of the pattern each time the vertical line is printed by one of the non-reference patterns P2 after another. In this example, because the inclination S is acquired in units of 2,400 dpi, two times the printing resolution of 1,200 dpi, the seven non-reference patterns P2 are matched to inclinations of +6, +4, +2, ±0, −2, −4 and −6, respectively.

Figure 14A:
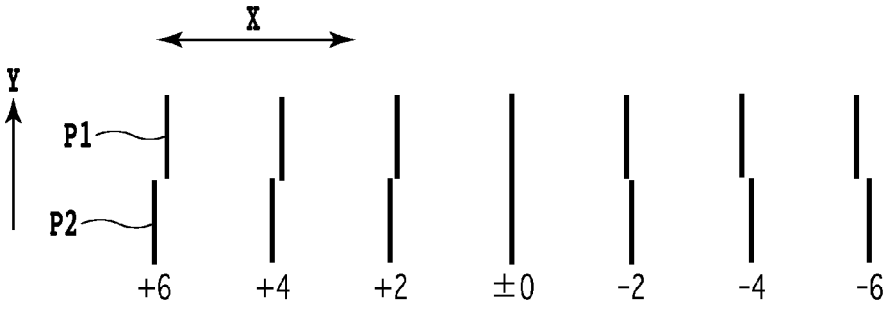
FIG. 14A and FIG. 14B illustrate printed results of different patterns of FIG. 13.
Figure 14B:
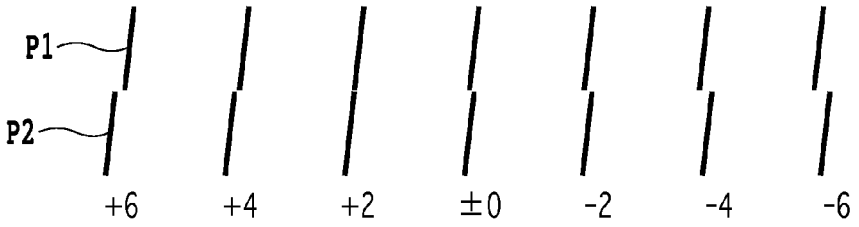

The reference pattern P1 is printed by using a bottom group of 256 nozzles arranged continuously upward from the lowermost nozzle NB of 1,200 nozzles in the nozzle array L (one-end nozzle group). Then, after a print medium is fed in the sub-scan direction by a distance equal to the length of the nozzle array L (in this case, 1 inch), a non-reference pattern P2 that matches an inclination of +6 is printed by using a top group of 256 nozzles arranged continuously downward from the uppermost nozzle NT (other-end nozzle group). This process is repeated until seven vertical line patterns, each a combination of the reference pattern P1 and one of the non-reference patterns P2, are printed as shown in FIG. 14A or FIG. 14B. These vertical line patterns can be printed separated from each other at a predetermined interval. The user then checks the seven vertical line patterns and selects one in which the reference pattern P1 and the non-reference pattern P2 are connected in a straight line. The inclination corresponding to the non-reference pattern P2 of the selected vertical line pattern is then acquired as the inclination S of the nozzle array L.

FIG. 14A shows a printed result of patterns when the nozzle array L has almost no inclination S, with a non-reference pattern P2, that matches the inclination of ±0, connecting with the reference pattern P1 in a straight line. If the nozzle array L is inclined, a non-reference pattern P2 other than the one matching the inclination of ±0 connects with the reference pattern P1 in a straight line, as shown in FIG. 14B. In the case of FIG. 14B, a non-reference pattern P2 matching the inclination S of +2 connects with the reference pattern P1 in a straight line. So, the inclination S of the nozzle array L can be determined to be "+2". In this example, since the resolution of these patterns in the main scan direction is 1,200 dpi, the nozzle array L with the inclination of "+2" has an inclination S in FIG. 12 of about 42 μm. If it is decided from the printed vertical line pattern that the inclination is approximately median between "+2" and "+4", a median value of "+3" may betaken as the inclination S. In this example, the inclination S can be acquired in units of 2,400 dpi. Therefore, the patterns shown in FIG. 14A and FIG. 14B are third patterns used to acquire the inclination of a nozzle array. To print the third patterns, the head unit functions as a third pattern printing unit under the control of the print control unit 500.

The inclination S of the n-th nozzle array acquired in step S14 of FIG. 11 is stored in a predetermined region (third storage portion) in the ROM 402. Here, first to fourth nozzle array (n=1 to n=4) are taken as nozzle arrays K, C, M, Y with inclinations of S(K), S(C), S(M), S(Y), respectively. So, the inclination detection unit includes a third pattern printing unit and an input unit for entering an amount of shift (equivalent to the inclination S). It is noted, however, that the inclination detection unit does not have to include the third pattern printing unit. For example, the surface of the print head in which the nozzle arrays are formed may be detected by an optical sensor to determine the inclination of the nozzle array.

The patterns P1, P2 are just an example and, to enhance the detection accuracy of the inclination, the resolution may further be increased. To widen the detection range of inclination, the horizontal size of the patterns may be expanded and the number of different non-reference patterns P2 increased. Further, to raise the level of recognizability of the vertical line patterns made up of patterns P1, P2, the vertical size of the patterns P1, P2 may be extended to elongate the vertical line or the width of the vertical line increased to more than two dots. If the number of nozzles used in the nozzle array is fewer than 256, the patterns P1, P2 may be required to be changed according to a variety of printing conditions, such as reducing the vertical size of the patterns P1, P2. It is also possible to acquire the inclination S by printing seven different non-reference patterns P2 along with seven reference patterns P1 in a one-to-one relation, taking density measurements of the printed patterns and determining the inclination S from the result of measurements. In that case, the patterns PA, PB, such as shown in FIG. 9, may be printed as the patterns P1, P2.

Next, from the inclination S of the n-th nozzle array L thus obtained, the positions of the nozzles to be used in the nozzle array L are acquired and, from these positions, an inclination coefficient k is determined (step S15). The inclination coefficient k corresponds to the print position shift or deviation resulting from the inclination of the nozzle array L. The print control unit 500 functions as a first calculation unit to determine the inclination coefficient k. Further, from the inclination coefficient k, a correction value B for adjusting the print position deviation resulting from the inclination of the nozzle array L is calculated (step S16). The method of calculating the correction value B will be explained as follows.

In the example of FIG. 12, the nozzles NA to be used in the nozzle array L are a group of nozzles ranging from nozzle number A1 to nozzle number A2. The nozzles NA to be used differ depending on the print mode. In the nozzle array L made up of a total of 1,200 nozzles, the lowermost nozzle NB is assigned a nozzle number 0 and the uppermost nozzle NT a nozzle number 1199. The nozzle numbers from A1 to A2 have a relation of A1<A2.

The inclination coefficient k is calculated from an equation (1) shown below. Here N represents the total number of nozzles in the nozzle array L and in this case N=1,200.

$$k=[\{(A2-A1)/2\}+A1-\{(N-1)/2\}]/\{(N-1)/2\} \quad (1)$$

From this inclination coefficient k and inclination S, the correction value B is determined by an equation (2) shown below.

$$B=k\times(S/2) \quad (2)$$

The correction value B corresponds to a distance between a position X(A) on the axis Ox, which represents a middle point of the group of nozzles NA to be used projected onto the axis Ox, and the origin of the axis Ox. The print control unit 500 functions as a second calculation unit to determine the correction value B.

Next, the correction value B will be explained by referring to FIG. 6C.

FIG. 6C is an enlarged view showing a positional relation between lines (L(C) and L(M)) in FIG. 6B printed with a cyan ink and a magenta ink, respectively. In FIG. 6C, the center lines O(C), O(M) of the printed lines L(C), L(M) do not match the misregistration adjustment position P associated with the nozzle arrays C and M. The reason for this misalignment is that, in addition to the nozzle arrays C, M having their own inclinations, the nozzles to be used are deviated from the center line of each nozzle array and situated near one of its sides. In such a case, to align the center lines O(C) and O(M) of the printed lines L(C) and L(M) requires a correction operation of shifting the positions of the center lines O(C), O(M) to the misregistration adjustment position P, as shown by the arrows in FIG. 6C. The amounts of position correction for the center lines O(C), O(M) correspond to the correction values B (C), B(M) for the nozzle arrays C, M, respectively.

Then, by repetitively executing the processing from step S13 to step 16 on all nozzle arrays K, C, M, Y, the correction values B for the nozzle arrays are calculated (step S17). The correction value B for a nozzle array with no inclination is 0 (B=0).

Next, at step S18, correction values (inter-color correction values) for print position deviations of nozzle arrays C, M, Y with respect to the reference nozzle array K are calculated as correction values C(C), C(M), C(Y) by the following equations (3), (4) and (5).

$$C(C)=B(C)-B(K) \quad (3)$$

$$C(M)=B(M)-B(K) \quad (4)$$

$$C(Y)=B(Y)-B(K) \quad (5)$$

Next, from the print position adjustment values (misregistration adjustment values) for high-speed mode V1(C), V1(M), V1(Y) described above, adjustment values (misregistration adjustment values) for high-quality mode V2(C), V2(M), V2(Y) are calculated (step S19). That is, print position adjustment values V2(C), V2(M), V2(Y) for nozzle arrays C, M, Y with respect to the reference nozzle array K are calculated by equations (6), (7), (8) shown below. These adjustment values are correction values that take into account the inclinations of the nozzle arrays (print head inclination) and the positions of nozzles to be used.

$$V2(C)=V1(C)-C(C) \quad (6)$$

$$V2(M)=V1(M)-C(M) \quad (7)$$

$$V2(Y)=V1(Y)-C(Y) \quad (8)$$

The adjustment values V2(C), V2(M), V2(Y) thus obtained are stored in a storage medium as adjustment values V2 for high-quality mode (step S20). Adjusting the print positions of the nozzle arrays C, M, Y with respect to that of the nozzle array K in the high-quality mode by using the adjustment values V2(C), V2(M), V2(Y) allows high-quality images with reduced color deviations to be printed.

In the above explanation, the inclinations S of nozzle arrays are determined from test patterns and, based on the inclinations, the correction values B are calculated. The method of determining the correction value B is not limited to this one. Since the correction value B is equivalent to the distance between the position X(A) and the origin of axis Ox, the correction value B can also be acquired by directly calculating the distance between the position X(A) and the origin of axis Ox. This may be achieved as follows. The reference pattern P1 (see FIG. 13) is formed by a nozzle situated at the center of the entire nozzle array and then the non-reference pattern P2 of FIG. 13 is formed by a nozzle situated at the center of the range of nozzles NA to be used. Then, a printed pattern in which the reference pattern P1 and the non-reference pattern P2 are connected in a straight line is selected, allowing the distance between the position X(A) and the origin of axis Ox to be determined directly. Therefore, the head unit and the print control means, both used to print the aforementioned patterns, and the input unit for entering the pattern printed result together constitute a third acquisition unit. It is noted, however, that printing the test patterns using the uppermost nozzle NT and the lowermost nozzle NB, as in the method of the second embodiment, makes a pattern misalignment in the main scan direction more distinctive, allowing the correction value B to be determined with an improved precision.

Other Embodiments

The number and kinds of inks used to print images, the order of applying a plurality of inks and the kinds of print modes are not limited to those of the embodiments described above but can be chosen arbitrarily. This invention can widely be applied to a variety of print modes activating different numbers of nozzles at different positions. The print modes may include one that uses all nozzles in a nozzle array and one that uses only a part of them. This invention can also be applied to a construction in which a plurality of print heads are arranged in line in the sub-scan direction so that the nozzle arrays formed in these print heads are connected end-to-end in the sub-scan direction. In that case, those connected nozzle arrays stretching in the sub-scan direction are taken as an extended nozzle array and a plurality of such extended nozzle arrays may be used, one for each of different inks. As with the preceding embodiments, in a plurality of print modes that activate nozzles at different positions in each extended nozzle array, the print position of each extended nozzle array can be adjusted by taking into consideration an inclination of each extended nozzle array (or inclination of the print head). The inclination of the extended nozzle array includes an inclination of at least one of a plurality of print heads making up the extended nozzle array.

The print head is not limited to an ink jet print head with ink ejecting nozzles as printing elements and may also include a print head having a variety of kinds of printing elements capable of applying ink to a print medium.

This invention is applicable to all devices that use print media including paper, cloth, leather, unwoven fabric and even metal. The applicable devices include office equipment such as printers, copying machines and facsimiles and industrial manufacturing machines. Further, this invention is particularly effectively applied to devices that print on large-size print media at high speed.

While the present invention has been described with reference to exemplary, embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-019162, filed Jan. 29, 2010, which is hereby incorporated by reference herein in its entirety.

What is claimed is:

1. A printing apparatus to print an image on a print medium by using a first printing element array and a second printing element array, each having a plurality of printing elements arrayed in a first direction for ejecting different kinds of inks respectively onto the print medium, wherein the first and second printing element arrays are arranged in a second direction crossing the first direction, and by moving the printing element arrays relative to the print medium in the second direction, the printing apparatus comprising:

a setting unit configured to set a first print mode and a second print mode, wherein a range of the first printing element array used in the second print mode is different from, in the first direction, a range of the first printing element array used in the first print mode;

a first acquisition unit configured to acquire a first adjustment value for adjusting, in the second direction, a print position of the printing elements in the range of the first printing element array that are used in the first print mode and a print position of the printing elements of the second printing element array that are used in the first print mode;

a second acquisition unit configured to acquire a second adjustment value for adjusting, in the second direction, a print position of printing elements in the range of the first printing element array that are used in the second print mode and a print position of printing elements of the second printing element array that are used in the second print mode;

a first adjustment unit configured to, when printing an image in the first print mode, adjust the print positions based on the first adjustment value acquired by the first acquisition unit; and a second adjustment unit configured to, when printing an image in the second print mode, adjust the print positions based on the second adjustment value acquired by the second acquisition unit.

2. The printing apparatus according to claim 1, wherein the first adjustment unit and the second adjustment unit adjust, according to the first adjustment value and the second adjustment value, a timing at which the printing elements eject ink.

3. The printing apparatus according to claim 1, further comprising:

a first pattern printing unit configured to print a first pattern, the first pattern including a reference pattern printed by the printing elements in the range of the first printing element array used in the first print mode and a plurality of non-reference patterns printed, shifted in the second direction, by the printing elements in the range of the second printing element array that are used in the first print mode; and a third acquisition unit configured to acquire, for each of the first printing element array and the second printing element array, a deviation in the second direction between a predetermined one of the printing elements in the range used in the first print mode and a predetermined one of the printing elements in the range used in the second print mode, wherein the first acquisition unit acquires the first adjustment value based on a printed result of the first pattern, and wherein the second acquisition unit acquires the second adjustment value based on the first adjustment value acquired by the first acquisition unit and on the deviation acquired by the third acquisition unit.

4. The printing apparatus according to claim 1, wherein a range of the second printing element array used in the second print mode is different from a range of the second printing element array used in the first print mode.

5. The printing apparatus according to claim 4, wherein the position of the printing elements in the range of the first printing element array that are used in the first print mode and the position of the printing elements in the range of the second printing element array that are used in the first print mode match in the first direction, and wherein the position of the printing elements in the range of the first printing element array that are used in the second print mode and the position of the printing elements in the range of the second printing element array that are used in the second print mode shift from each other in the first direction.

6. The printing apparatus according to claim 5, wherein, in the second print mode, a moving of the printing element arrays relative to the print medium for printing an unit area of the print medium by using the range of the first printing element array is different from a moving of the printing element arrays relative to the print medium for printing the unit area of the print medium by using the range of the second printing element array.

7. The printing apparatus according to claim 4, wherein, in the first print mode, all printing elements in the first printing element array and the second printing element array are used, and wherein, in the second print mode, a part of the printing elements in each of the first printing element array and the second printing element array is used.

8. The printing apparatus according to claim 4, further comprising:

a first pattern printing unit configured to print a first pattern, the first pattern including a reference pattern printed by the printing elements in the range of the first printing element array that are used in the first print mode and a plurality of non-reference patterns printed, shifted in the second direction, by the printing elements in the range of the second printing element array that are used in the first print mode; and a second pattern printing unit configured to print a second pattern, the second pattern including a reference pattern printed by the printing elements in the range of the first printing element array that are used in the second print mode and a plurality of non-reference patterns printed, shifted in the second direction, by the printing elements in the range of the second printing element array that are used in the second print mode, wherein the first acquisition unit acquires the first adjustment value based on a printed result of the first pattern, and wherein the second acquisition unit acquires the second adjustment value based on a printed result of the second pattern.

9. The printing apparatus according to claim 4, further comprising:

a first pattern printing unit configured to print a first pattern, the first pattern including a reference pattern printed by the printing elements in the range of the first printing element array used in the first print mode and a plurality of non-reference patterns printed, shifted in the second direction, by the printing elements in the range of the second printing element array that are used in the first print mode; and an inclination detection unit configured to detect inclinations in the second direction of the first printing element array and the second printing element array, wherein the first acquisition unit acquires the first adjustment value based on a printed result of the first pattern, and wherein the second acquisition unit acquires the second adjustment value based on the first adjustment value acquired by the first acquisition unit, on the inclinations of the first printing element array and the second printing element array detected by the inclination detection unit and on the positions of the printing elements in the ranges of the first and second printing element arrays that are used in the second print mode.

10. The printing apparatus according to claim 9, further comprising:

a third pattern printing unit configured to print a third pattern, the third pattern including a reference pattern printed by printing elements situated at one end of the first printing element array and the second printing element array and a plurality of non-reference patterns printed, shifted in the second direction, by printing elements situated at the other end of the first printing element array and the second printing element array, wherein the inclination detection unit detects, based on a printed result of the third pattern, the inclinations in the second direction of the first printing element array and the second printing element array.

11. The printing apparatus according to claim 9, wherein the inclinations are equivalent to deviations in the second direction between the printing elements at the one end of each of the printing element arrays and the printing elements at the other end.

12. A printing method for printing an image on a print medium by using a first printing element array and a second printing element array, each having a plurality of printing elements arrayed in a first direction for ejecting different kinds of inks respectively onto the print medium, wherein the first and second printing element arrays are arranged in a second direction crossing the first direction, and by moving the printing element arrays relative to the print medium in the second direction, the printing method comprising the steps of:

printing an image in a first print mode and a second print mode, wherein a range of the first printing element array used in the second print mode is different from, in the first direction, a range of the first printing element array used in the first print mode;

acquiring a first adjustment value for adjusting, in the second direction, a print position of the printing elements in the range of the first printing element array that are used in the first print mode and a print position of the printing elements of the second printing element array that are used in the first print mode; and acquiring a second adjustment value for adjusting, in the second direction, a print position of the printing elements in the range of the first printing element array that are used in the second print mode and a print position of the printing elements of the second printing element array that are used in the second print mode, wherein, in the printing step, when an image is printed in the first print mode, the print position is adjusted based on the first adjustment value and, when an image is printed in the second print mode, the print position is adjusted based on the second adjustment value.

13. The printing method according to claim 12, wherein, in the printing step, a timing at which the printing elements eject ink is adjusted based on the first adjustment value and the second adjustment value.

14. The printing method according to claim 12, further comprising the steps of:

printing a first pattern, the first pattern including a reference pattern printed by the printing elements in the range of the first printing element array used in the first print mode and a plurality of non-reference patterns printed, shifted in the second direction, by the printing elements in the range of the second printing element array that are used in the first print mode; and acquiring, for each of the first printing element array and the second printing element array, a deviation in the second direction between a predetermined one of the printing elements in the range used in the first print mode and a predetermined one of the printing elements in the range used in the second print mode, wherein the first adjustment value is acquired based on a printed result of the first pattern, and wherein the second adjustment value acquired based on the first adjustment value and on the deviation acquired by the acquiring step.

15. The printing method according to claim 12, wherein a range of the second printing element array used in the second print mode is different from a range of the second printing element array used in the first print mode.

16. The printing method according to claim 15, wherein the position of the printing elements in the range of the first printing element array that are used in the first print mode and the position of the printing elements in the range of the second printing element array that are used in the first print mode match in the first direction, and wherein the position of the printing elements in the range of the first printing element array that are used in the second print mode and the position of the printing elements in the range of the second printing element array that are used in the second print mode shift from each other in the first direction.

17. The printing method according to claim 16, wherein, in the second print mode, a moving of the printing element arrays relative to the print medium for printing an unit area of the print medium by using the range of the first printing element array is different from a moving of the printing element arrays relative to the print medium for printing the unit area of the print medium by using the range of the second printing element array.

18. The printing method according to claim 15, wherein, in the first print mode, all printing elements in the first printing element array and the second printing element array are used, and wherein, in the second print mode, a part of the printing elements in each of the first printing element array and the second printing element array is used.

19. The printing method according to claim 15, further comprising the steps of:

printing a first pattern, the first pattern including a reference pattern printed by the printing elements in the range of the first printing element array that are used in the first print mode and a plurality of non-reference patterns printed, shifted in the second direction, by the printing elements in the range of the second printing element array that are used in the first print mode; and printing a second pattern, the second pattern including a reference pattern printed by the printing elements in the range of the first printing element array that are used in the second print mode and a plurality of non-reference patterns printed, shifted in the second direction, by the printing elements in the range of the second printing element array that are used in the second print mode, wherein the first adjustment value is acquired based on a printed result of the first pattern, and wherein the second adjustment value is acquired based on a printed result of the second pattern.

20. The printing method according to claim 15, further comprising the steps of:

printing a first pattern, the first pattern including a reference pattern printed by the printing elements in the range of the first printing element array used in the first print mode and a plurality of non-reference patterns printed, shifted in the second direction, by the printing elements in the range of the second printing element array that are used in the first print mode; and detecting inclinations in the second direction of the first printing element array and the second printing element array, wherein the first adjustment value is acquired based on a printed result of the first pattern, and wherein the second adjustment value is acquired based on the first adjustment value, on the inclinations of the first printing element array and the second printing element array detected by the detecting step and on the positions of the printing elements in the ranges of the first and second printing element arrays that are used in the second print mode.

21. The printing method according to claim 20, further comprising the step of:

printing a third pattern, the third pattern including a reference pattern printed by printing elements situated at one end of the first printing element array and the second printing element array and a plurality of non-reference patterns printed, shifted in the second direction, by printing elements situated at the other end of the first printing element array and the second printing element array, wherein the inclinations in the second direction of the first printing element array and the second printing element array is detected based on a printed result of the third pattern.

22. The printing method according to claim 20, wherein the inclinations are equivalent to deviations in the second direction between the printing element at the one end of each of the printing element arrays and the printing element at the other end.

* * * * *